United States Patent [19]

Tufte

[11] Patent Number: 4,640,483

[45] Date of Patent: Feb. 3, 1987

[54] PLATFORM DEVICE

[76] Inventor: Jerold W. Tufte, Box 79, Glenfield, N. Dak. 58443

[21] Appl. No.: 704,790

[22] Filed: Feb. 25, 1985

[51] Int. Cl.[4] ..... A47K 1/08

[52] U.S. Cl. ..... 248/311.2; 141/369; 248/231

[58] Field of Search ..... 248/311.2, 231, 146, 248/218.4, 219.1; 222/192; 141/380, 369, 364, 1, 98; 211/107, 205, 196; 24/306, 442, 16 R

[56] References Cited

U.S. PATENT DOCUMENTS

| | | | |
|---|---|---|---|
| 123,356 | 2/1872 | Nickels | 248/146 |
| 130,863 | 8/1872 | Pellett | 248/231 |
| 882,850 | 3/1908 | Troell | 248/231 X |
| 1,017,756 | 2/1912 | Head | 248/146 X |
| 1,095,242 | 5/1914 | Swift | 248/231 |
| 2,074,589 | 3/1937 | Knapp | 141/369 |
| 2,168,136 | 8/1939 | Playfair | 248/311.2 X |
| 2,530,039 | 11/1950 | Ashcraft | 222/192 |
| 2,615,238 | 10/1952 | Highwood | 248/146 X |
| 3,159,190 | 12/1964 | Skiéra | 141/369 |
| 3,429,542 | 2/1969 | Fagan | 211/75 X |
| 3,599,684 | 8/1971 | Elias | 141/369 |
| 3,610,409 | 11/1969 | Graf | 248/311.2 X |
| 3,648,830 | 3/1972 | Graf | 248/311.2 X |

FOREIGN PATENT DOCUMENTS

| | | | |
|---|---|---|---|
| 288760 | 9/1931 | Italy | 141/369 |
| 173840 | 12/1960 | Sweden | 141/369 |

*Primary Examiner*—J. Franklin Foss
*Assistant Examiner*—Sarah A. Lechok Eley
*Attorney, Agent, or Firm*—Robert E. Kleve

[57] ABSTRACT

The platform support invention comprises a device for attachment to a liquid dispenser of the pump type for dispensing fluid from its spout while upright. The platform support invention has a platform which is mounted to one side of the dispenser and extends about the dispenser and has securing means to secure the platform to the dispenser in fixed relation. The platform is directly beneath the spout and spaced above the bottom of the dispenser, and whereby when a receptacle is placed on the platform it will be beneath the spout and spaced above the bottom of the dispenser so as to conveniently receive fluid pumped from the spout of the dispenser without the operator having to physically hold the receptacle in that position.

1 Claim, 8 Drawing Figures

FIG. 3
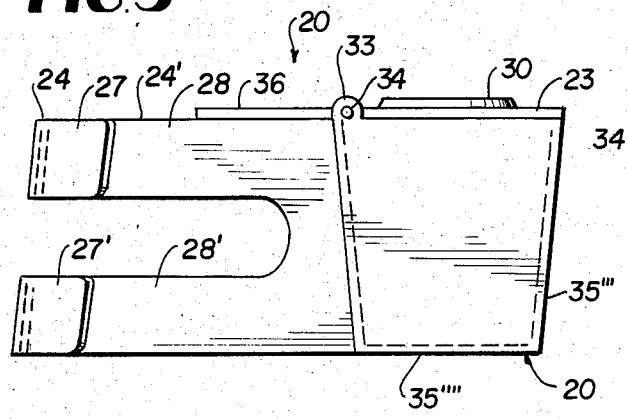
FIG. 4
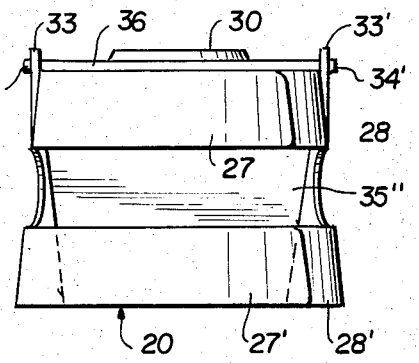
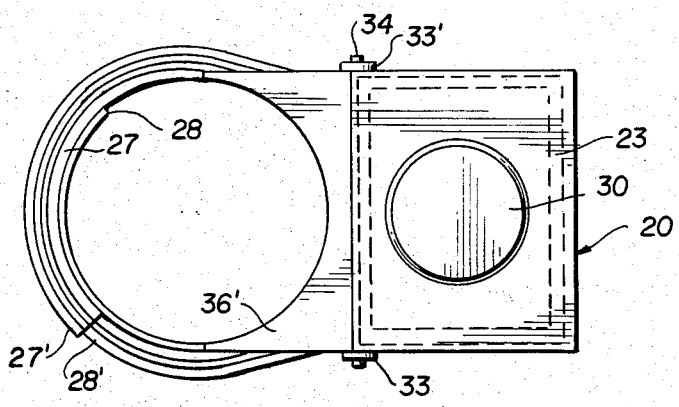
FIG. 5
FIG. 6
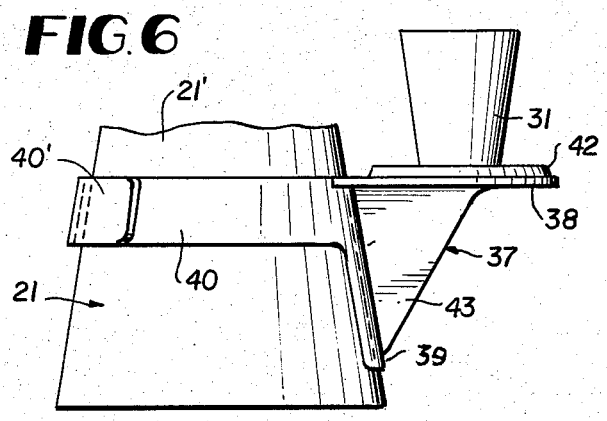
FIG. 7
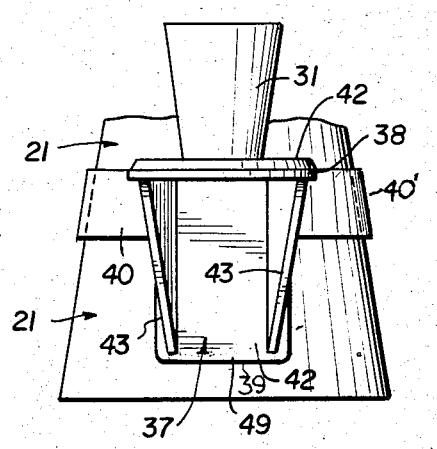
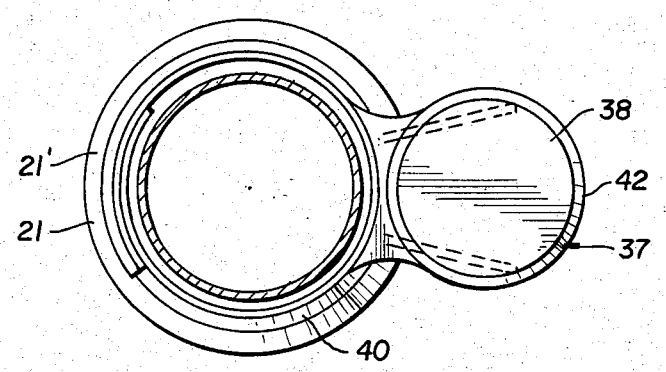
FIG. 8

PLATFORM DEVICE

This invention relates to liquid dispensing apparatus, more particularly, to attachment to dispensers of the pump type.

It is an object of the invention to provide a novel support to a pump type liquid dispenser of a platform mounted to the dispenser beneath the spout of the dispenser and spaced above the bottom of the dispenser and carried and supported by the dispenser to support a liquid receptacle beneath the spout, so that the receptacle can receive liquid pumped from the dispenser.

It is another object of the invention to provide a novel platform attachment to a pump type liquid dispenser to be carried by the dispenser having a platform mounted to one side of the dispenser and aligned directly beneath the spout of the dispenser so that the platform may support a receptacle to be used to receive fluid dispensed from the spout of the dispenser.

Further objects and advantages of the invention will become apparent as the description proceeds and when taken in conjunction with the accompanying drawings wherein.

FIG. 3 is a side elevational view of the platform attachment device.

FIG. 4 is a front elevational view of the platform attachment device.

FIG. 5 is a top plan view of the platform attachment device.

FIG. 6 is a side elevational view of a first modified form, a platform device shown operatively attached to a liquid dispenser.

FIG. 7 is a front elevational view of a first modified form of a platform device.

FIG. 8 is a top plan view of the first modified form of a platform device.

Figure 1:
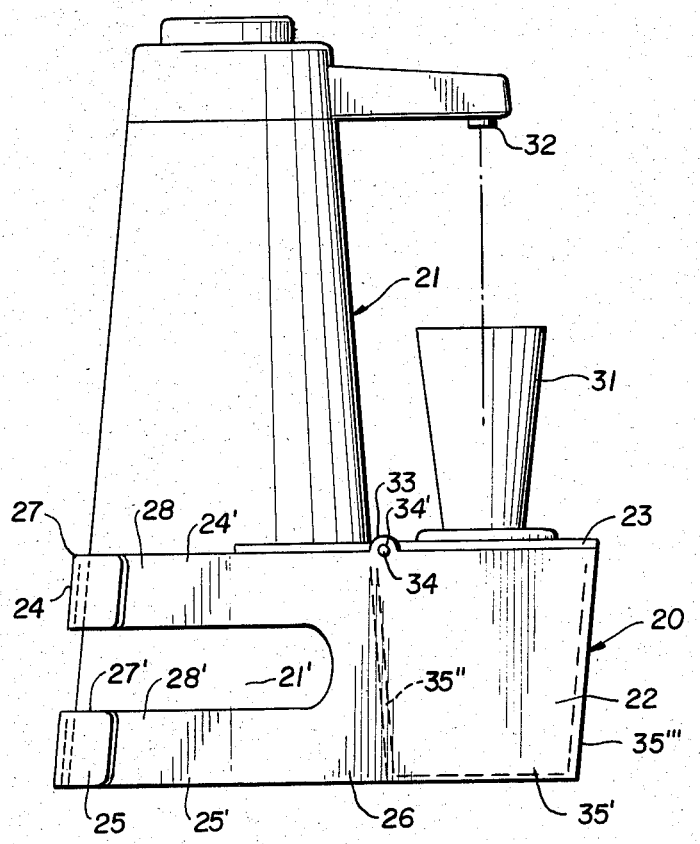
FIG. 1 is a side elevational view of the platform attachement device shown opperatively attached to a pump type liquid coffee dispenser. The platform of this form also has a receptacle beneath the platform and the platform is pivotally mounted to the top of the receptacle.
Figure 2:
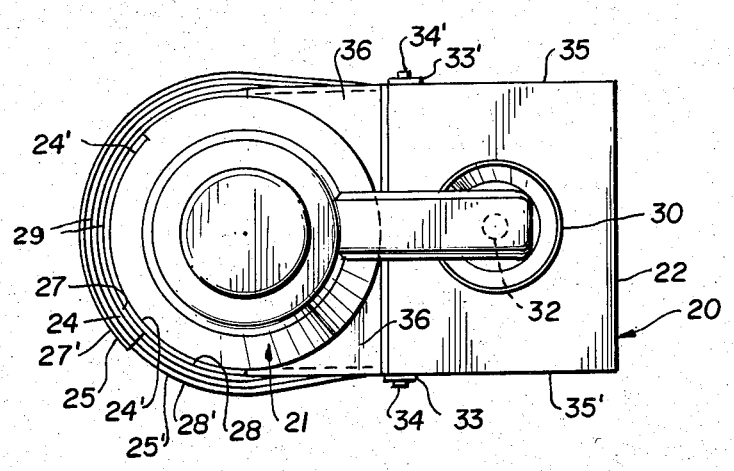
FIG. 2 is a top plan view of the platform attachement device shown operatively attached to a pump type coffee dispenser.

Referring more particularly to the drawings in FIG. 1, the receptacle platform holding apparatus 20 is illustrated as shown mounted to the pump type coffee dispenser 21 at the bottom position 21' of the dispenser.

The receptacle platform holder apparatus 20 has a front receptacle 22 with a pivotally mounted top 23 which also serves as a platform. The top or platform 23 is pivotally mounted to the top of the receptacle. A dual pair of plastic straps 24 and 24' and a pair of plastic straps 25 and 25' each have their inner ends 26 fixed to the opposite sides 35 and 35' of the receptacle 22. The straps extend about the bottom portion 21' of the dispenser.

The outermost ends 27 and 28, and 27' and 28' of the straps overlap one another. The outermost ends 27 and 28 have a substance known by the trademark "Velcro" along their inner and outer faces 29 where the outermost ends 27 and 28 overlap and the "Velcro" on strap 24 engages the "Velcro" on strap 24 to lock the straps 24 and 24' together tightly about the coffee dispenser portion as to frictionally lock the apparatus to the dispenser.

Similarly the outermost ends 27' and 28' also have the substance known by the trademark "Velcro" along the inner and outer faces 29 where their outermost ends 27' and 28' overlap and the Velcro on strap 25 engages the "Velcro" strap 25' to lock the straps 25 and 25' together tightly about the coffee dispenser portion to thereby also frictionally lock the apparatus to the dispenser.

The ever increasing diameter of the dispenser in the direction toward the bottom of the dispenser enables the upper and lower pair of straps 24, 24',25, & 25' to be drawn tightly together about the dispenser, so that their diameters are smaller than the diameter of the respective portions of the dispenser beneath the straps, this thereby prevents downward movement of the straps on the dispenser and thereby suspends and mounts the straps and apparatus to the dispenser so as to be supported and carried by the dispenser, as illustrated in the drawing. The "Velcro" strap material on each of the straps enables the overlapping portion of the strap to be adjusted to different positions tightened about the dispenser.

The top or platform 23 of the receptacle 22 has a raised ring 30 mounted in the top surface of the top panel or platform 23. The top or platform 23 serves as a platform to support a receptacle 31 for carrying liquid therein and the raised ring 30 serves as a centering ring for aligning the placement of the receptacle 31, as illustrated in the drawing, so that the receptacle 31 is vertically aligned beneath and below the spout 32 of the dispenser to receive fluid pumped from the spout of the dispenser, while the dispenser remains upright as illustrated.

Some forms of coffee dispensers or hot liquid dispensers have a lever handle which serves the same purpose, namely to pump the coffee or hot liquid out of the dispenser throught the spout, while the dispenser remains in its upright illistrated position.

The apparatus 20 by having the platform when mounted to the dispenser, spaced upward toward the spout provides a supporting surface and directly beneath the spout enables a drinking receptacle 31, for example, to be placed on the platform and aligned directly beneath and below the spout so as to receive coffee or other hot liquids dispensed from the spout, with the receptacle 31 sufficiently close to the spout as to minimize or reduce the splashing of the liquid when dropping from the spout into the receptacle 31, and to eliminate the need for the operator to hold the receptacle 31 in a similar position to receive the liquid dispensed from the spout.

The receptacle 22 has four sides 35, 35', 35'', and 35''' with the straps 24, 24', 25, and 25' having their one ends fixed to the sides 35 and 35' of the receptacle 22. A pair of flanges 33 and 33' are fixed to the sides 35 and 35' of the receptacle 22 and the top or platform 23 has a pair of pins 34 fixed to its opposite edges that are rotatably mounted in bores in flanges 33 and 33' to pivotally mount the top or platform 23 to the receptacle 22.

A horizontal panel 36 is fixed to the top of side 35'' and extends toward the dispenser with a curved inner edge 36' engaging the dispenser.

The receptacle 22 of the apparatus may be used to carry various items such as a drinking receptacle, food, luncheon material and etc.

The first modified form of the invention 37 is illustrated in FIGS. 6, 7, and 8 as having a platform 38 fixed to a flexible curved surface sheet 39, having a pair of upper strap portions 40 and 40' which extend about the bottom portions 21 of a pump type hot liquid dispenser 21 to frictionally fix the sheet 39 and platform 38 to the dispenser 21 in a manner similar to that of the first form of the invention illustrated in FIGS. 1–5 so that the invention 37 is carried by the dispenser. The overlapping portions of straps 40 and 40' will each have straps of locking material of the substance known by the trademark name of "Velcro" to lock the overlapping portion of straps 40 and 40' together, tightly about the dispenser in fixed frictional relation, so the dispenser will carry and support the apparatus. The curved sheet 39 has a portion 49 that is frusto conical so that it extends around the back of the dispenser 20 in flush relation. A pair of brace panels 43 are fixed between the platform 38 and the back portion 49 of the sheet.

The platform 38 also has a raised ring 42 moulded therein serving the same purpose as the ring 30 and a drinking receptacle 31 can be positioned on the platform 38, and the platform will be aligned to be vertically beneath the spout of the dispenser 21 acting to support the receptacle 31 directly beneath the spout of the ispenser and spaced above the bottom of the dispenser in the same position relative to the spout as illustrated in FIG. 1 to enable hot fluid to be pumped from the spout of the dispenser into the receptacle while the dispenser remains upright without the operator having to physically hold the receptacle 31 in that position in the same manner and construction as in the first form of the invention as illustrated in FIG. 1–5. The dispenser 21 is only a fragmentary showing in the first modified form.

The receptacle of the first form also has a bottom 35''''. Thus, it will be seen that a novel platform for supporting a receptacle directly below the spout of the dispenser has provided.

It will be obvious that various changes and departures may be made to the invention without departing from the spirit and scope thereof and accordingly it is not intended that the invention be limited to that specifically described in the specification or as illustrated in the drawings but only as set forth in the appended claims wherein.

What is claimed is:

1. A support platform device for attachment to a liquid dispenser of the pump type for dispensing fluid from its spout while upright, said platform device comprising a horizontal platform; a pair of straps having connecting means connecting their one ends to the platform and adapted to be extended about the dispenser with securing means at their outer ends to secure outer ends to one another and in fixed relation to the dispenser so as to secure the platform to the dispenser, so that the dispenser supports the platform; said platform serving to support a receptacle for receiving fluid, with said platform and receptacle being directly below the spout and spaced above the bottom of the dispenser so as to conveniently receive fluid pumped from the spout into the receptacle; said connecting means comprising a second receptacle mounted to said straps beneath the spout; said platform being operatively mounted to said second receptacle to also serve as a top.

* * * * *